US008701439B2

(12) United States Patent
Sieradzki

(10) Patent No.: US 8,701,439 B2
(45) Date of Patent: Apr. 22, 2014

(54) PIECE OF JEWELRY COMPRISING A BEZEL IMMOBILIZED IN TRANSLATION AND IN ROTATION ON A WIRE-LIKE MOUNTING

(75) Inventor: Arthur Sieradzki, Etesi (FR)

(73) Assignee: Etesi, Paris (FR)

( * ) Notice: Subject to any disclaimer, the term of this patent is extended or adjusted under 35 U.S.C. 154(b) by 0 days.

(21) Appl. No.: 13/375,113

(22) PCT Filed: May 27, 2010

(86) PCT No.: PCT/FR2010/000394

§ 371 (c)(1),
(2), (4) Date: Apr. 12, 2012

(87) PCT Pub. No.: WO2010/136674

PCT Pub. Date: Dec. 2, 2010

(65) Prior Publication Data

US 2012/0186298 A1 Jul. 26, 2012

(30) Foreign Application Priority Data

May 29, 2009 (FR) ..... 09 02608

(51) Int. Cl.
*A44C 17/02* (2006.01)

(52) U.S. Cl.
USPC ..... 63/26; 63/27; 59/2; 59/83; 59/93; 29/10; 29/896.41

(58) Field of Classification Search
None
See application file for complete search history.

(56) References Cited

U.S. PATENT DOCUMENTS

| | | | | |
|---|---|---|---|---|
| 645,909 | A * | 3/1900 | Boismaure | 63/31 |
| 6,094,939 | A | 8/2000 | Gavello | |

FOREIGN PATENT DOCUMENTS

| | | | |
|---|---|---|---|
| EP | 1 819 253 | A1 | 8/2007 |
| FR | 455439 | A | 7/1913 |
| FR | 608150 | A | 7/1926 |
| FR | 1228216 | A | 8/1960 |

* cited by examiner

*Primary Examiner* — Jack W. Lavinder
(74) *Attorney, Agent, or Firm* — Sughrue Mion, PLLC

(57) ABSTRACT

Jewel having a decorative element such as a precious stone, a bezel including a body provided with at least one hole defining a longitudinal direction, the body having claws mounted thereon, which embed the decorative element, a wire-like support on which the bezel is mounted, the wire-like support extending longitudinally through the body of the bezel through the hole. The wire-like support has a bore located in the body, and the jewel further has an elongated stop element, which extends transversely in the body while passing through the bore formed in the wire-like support. The stop element is engaged with stop surfaces formed within the body.

14 Claims, 5 Drawing Sheets

PIECE OF JEWELRY COMPRISING A BEZEL IMMOBILIZED IN TRANSLATION AND IN ROTATION ON A WIRE-LIKE MOUNTING

CROSS REFERENCE TO RELATED APPLICATION

This application is a National Stage of International Application No. PCT/FR2010/000394 filed May 27, 2010, claiming priority based on French Patent Application No. 09/02608, filed May 29, 2009, the contents of all of which are incorporated herein by reference in their entirety.

FIELD OF THE INVENTION

The invention generally relates to jewelry. It relates to a jewel such as a necklace, a bracelet, a pendent, an ear ring or a ring, including a wire-like support on which at least a bezel is mounted, said bezel enclosing a decorative element (e.g. a precious stone), and to a manufacturing process thereof.

BACKGROUND OF THE INVENTION

The manufacturing of jewels is so ancient it is impossible to date. The Louvre collections show that certain classic setting techniques of precious stones on bezels, still utilized nowadays, were already known in antique Egypt. The slipping of bezels on wire-like supports (e.g. golden chains) has also been known for a long time, such as for the manufacturing of necklace and bracelets. The basic technique is simple, for it suffices to drill a hole within the bezel, through which the wire-like support is inserted.

More complex are the techniques aiming at immobilizing the bezels on the wire-like support in order to prevent slipping of the bezel or even rotation of the bezel around the axis of the support, whenever it is compulsory to always present the same decorative face.

An ordinary technique allowing for immobilization in translation of the bezel consists in mounting stop rings on each side of the bezel and in setting the stop rings on the wire-like support. This technique is however tiresome, costly because of additional material, and the result is often unaesthetic.

Another technique consists in injecting glue between the bezel and the wire-like support, thereby providing double immobilization: both in translation and in rotation. However, it requires additional material, the mechanical properties (especially resistance to fatigue) and physic-chemical properties (especially resistance to oxidation) may appear uncertain and not constant in time. Moreover, the final result may appear unaesthetic, especially when the injection technique is not well mastered, or whenever the glue viscosity and drying time are not adapted (e.g. glue is too fluid or on the contrary too viscous; the drying too slow, or on the contrary too fast).

Those drawbacks are much important in the manufacturing of jewels of complex structure or, moreover, of small dimensions, since at the millimetric scale (and below), the effects of friction (capillarity) are greater than the effects of gravity, and the precise applications of glues is extremely tricky. This is why turning to mechanical techniques of immobilization is required.

It is known from European patent application No. EP 1 819 523 a technique consisting of creating a roll on the wire-like support inside the bezel for immobilizing the bezel in translation and, whenever possible, in rotation.

Practically, this technique is presently utilized on a large scale for the manufacturing of jewels including a wire made of a thermoplastic transparent material (such as fishing line), on which bezels are slipped, embedding precious stones such as diamonds. After having inserted the wire in the bezel, one introduces in the bezel the tip of a welding iron, which is applied at the end of the wire. Under the heat, a spheroid roll forms at the end of the wire, within the bezel. This operation may be symmetrically repeated, such that both rolls thus created, having a diameter greater than the holes in the bezel, thereby immobilize the bezel on the wire at the desired position. This technique, together with the interesting mechanical properties of the fishing line (altogether flexible, resistant to traction, to torsion and to shearing), makes it possible to realize jewelry of complex forms (such as a butterfly).

The general satisfaction of clients made the commercial success of those jewels possible. The attention of the inventors has however been drawn to some cases of dissociation of the wire and bezel, allowing at least the rotation of the bezel, and even—although less often—their separation.

Studies conducted by the applicant have permitted to identify three main causes to those incidents:

- some clients' habit to constantly handle their jewel, rotating the bezel between the thumb and index, the cyclical solicitations thereby loosening the bezel on the wire;
- the wire loosing resistance when exposed to light, since nylon is known as sensitive to ultraviolets;
- the rupture of the wire and the forming of rolls potentially being less precise and repetitive during the application of the welding iron.

SUMMARY OF THE INVENTION

The invention aims at alleviating those drawbacks, proposing a new manufacturing technique allowing, with increased reliability, to immobilize a bezel on a wire-like support.

The invention therefore provides, in a first aspect, a jewel including:

- a decorative element such as a precious stone,
- a bezel including a body provided with at least one hole defining a longitudinal direction, the body having claws mounted thereon, which embed said decorative element,
- a wire-like support on which the bezel is mounted, the wire-like support extending longitudinally through the body of the bezel through the hole and having a bore located in the body,
- an elongated stop element, which extends transversely in the body while passing through the bore formed in the wire-like support, the stop element being engaged with stop surfaces formed within the body.

Accordingly, the bezel is blocked in translation and in rotation with respect of the wire-like support.

The invention provides, in a second aspect, a method of manufacturing a jewel comprising at least a bezel including a body provided with at least one hole defining a longitudinal direction, the body having claws mounted thereon, which embed said decorative element, and at least one wire-like support, said method including the following operations:

- longitudinally introducing the wire-like support in the bezel through the hole,
- introducing an elongated stop element in the body through a bore formed in the wire-like support and located in the body,
- placing the stop element in engagement with stop surfaces formed in the body.

The above and other objects and advantages of the invention will become apparent from the detailed description of preferred embodiments, considered in conjunction with the accompanying drawings.

DETAILED DESCRIPTION

Figure 1:
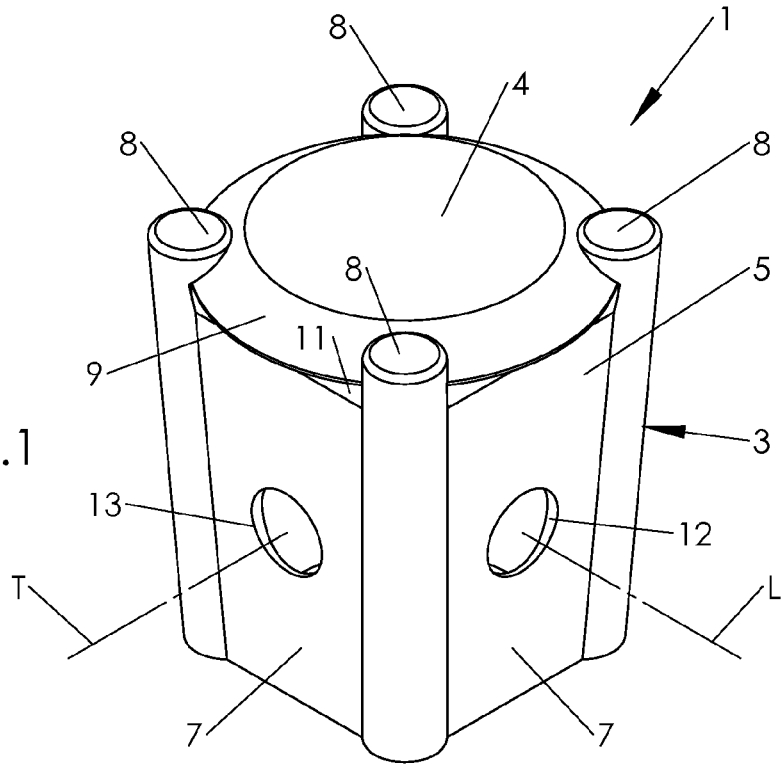
FIG. 1 is a top perspective view showing a bezel provided with holes for its mounting on a wire-like support.
Figure 2:
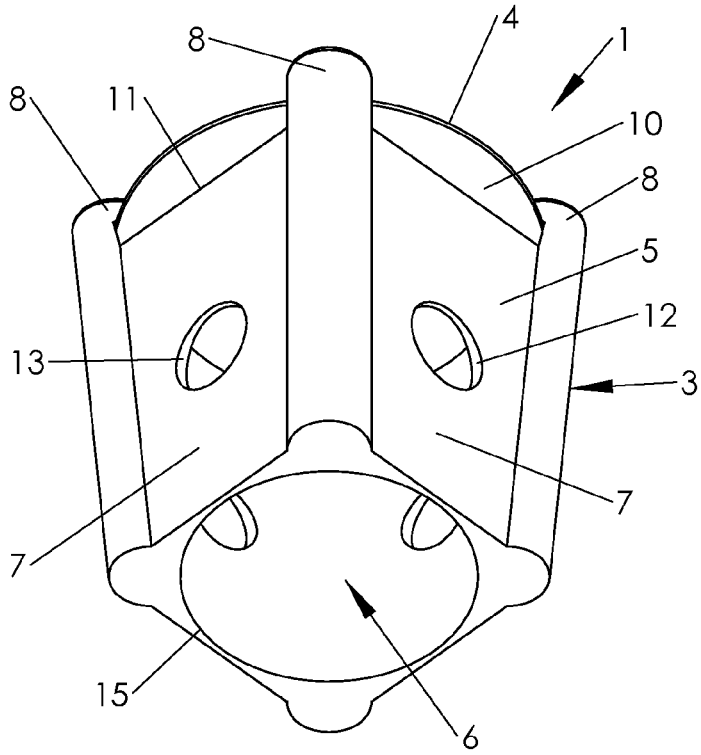
FIG. 2 is a bottom perspective view of the bezel of FIG. 1.
Figure 3:
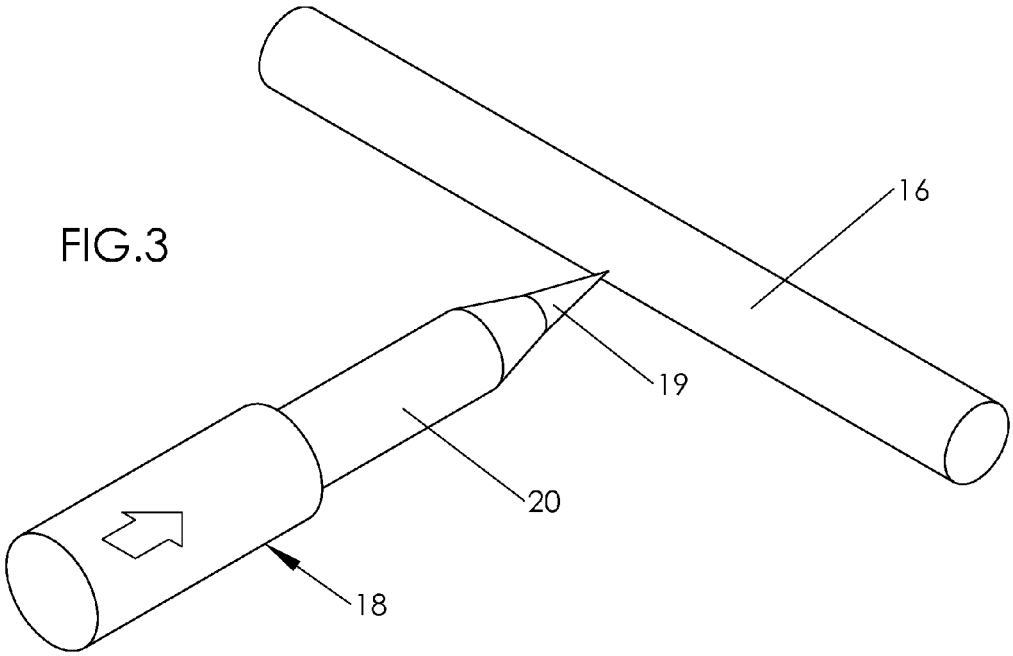
FIG. 3-9 are partial cut-out perspective view showing several steps of manufacturing a jewel with a technique according to the invention.
Figure 4:
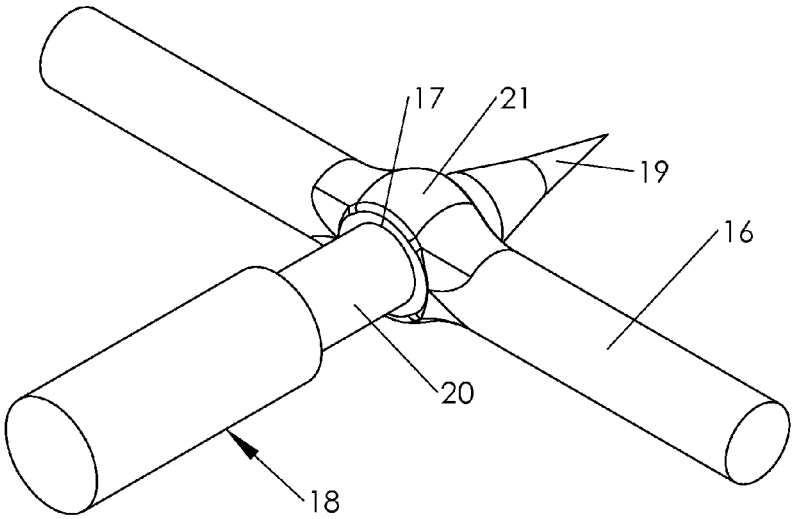

Shown on FIG. 1 is a carved object 1 included in a jewel 2 such as a necklace, a bracelet, an ear ring, a ring, etc. Object 1 includes a bezel 3 provided with a decorative element 4 mounted thereon, here a cut precious stone such as a diamond, a ruby, an emerald, an aquamarine, etc.

The bezel 3 is preferably made of a precious metal such as platinum, yellow or white gold, silver. The bezel 3 comprises a hollow body defining a cavity 6. The body 5 is here provided with a square section, and has four planar faces 7 substantially parallel to each other by pairs. At an upper end, the body 5 is mounted with four claws 8 which protrude from the corners of the body 5, at four junctions between the faces 7. The stone 4 has an upper part 9 or crown, on which the claws 8 apply, and a lower part 10 or breech, which applies onto an upper edge 11 of the body 5, and partly extends in the cavity 6.

The body 5 is provided with at least one pair of holes 12 of circular shape, formed in at least two faces 7 facing each other. The body 5 is provided with two pairs of holes 12, 13 (i.e. four holes), one hole being provided in each face 7.

Both coaxial holes 12 of a first pair, the common axis L of which defines a longitudinal direction, are provided in two parallel faces 7 facing each other, whereas both coaxial holes 13, the common axis R of which defines a transversal direction perpendicular to the longitudinal direction L, are provided in the other faces 7, also parallel to and facing each other.

The body 5 has, at its upper end, a first opening 14 forming a passage for the breech 10 and, at an opposite lower end, a second opening 15, which forms an access (both visual and mechanical, by means of suitably dimensioned tools) inside the cavity 6.

It shall be understood that, according to one embodiment, the bezel 3 has an overall width (i.e. distance between parallel faces) of 2.2 mm (22 tenths of millimeters) and an overall height (from the lower end to the tip of the claws 8 of 2.5 mm (25 tenths of milliliters) for a diamond stone of 0.04 carat (diameter 2.2 mm); the holes 7 have a diameter of 0.4 mm (4 tenths of millimeters).

For the manufacturing of a jewel 2, the bezel 3 is mounted on a wire-like support 16, hereinafter more simply called wire. It is preferably a wire formed in a transparent or translucent thermoplastic material, which may be colored, but advantageously not colored. As an example, a fishing line may be used, the diameter of which may be equal (with a clearance) to the diameter of the holes (i.e. 4/10 mm in the present example).

The most common materials for the manufacturing of fishing lines are polyamides (i.e. Nylon). One may use this material, the resistance of which is great but which sometimes weakens under cyclical constraints (such as traction). It might therefore be preferable to chose new materials, which tend to replace Nylon in the manufacturing of fishing lines. One may cite PolyVinyliDene Fluoride (PVDF), better known as Fluorocarbon. Compared to Nylon, PVDF has indeed the advantage, being a fluorinated polymer, to offer an increased resistance to temperature variations and to ultraviolets. From a visual aspect, PVDF has a refraction index (about 1.33) lower than the refraction index of Nylon (about 1.66), which makes PVDF more transparent than Nylon. It is also possible to use composite Nylon/Fluorocarbon or glass fiber.

As it shall be seen, the bezel 3 is not simply mounted on the wire 16; it is also immobilized in translation and rotation thereon.

A manufacturing method of a jewel is now disclosed, with reference to FIG. 3-9.

It starts (FIG. 3-4) with forming a bore 17 through the wire 16, perpendicular to its axis, by means of a sharp tool 18 such as a nail, a needle, a drill or a gimlet. The tool 18 has a pointed edge 19, possibly provided with a helical cutting edge permitting to achieve a cutting by stock removal, followed with a smooth cylindrical body 20 having the same diameter as the wire 16.

The bore 17 is formed by passing the tool 18 through the wire 16, together with a possible rotation of the tool 18 at the beginning of the operation, for example when the head 19 is provided with a cutting edge to achieve a cutting by stock removal. At the end of the operation, the body 20 of the tool 18 is inserted in the start of the thus created bore, to enlarge it to the desired diameter (that of the wire). No cutting by stock removal is realized at this stage, the diameter setting of the bore 17 being made by simply bending the material. Therefore, as seen on FIG. 4, a roll 4 of material is formed on each side of the bore 17, parallel to its axis.

Figure 5:
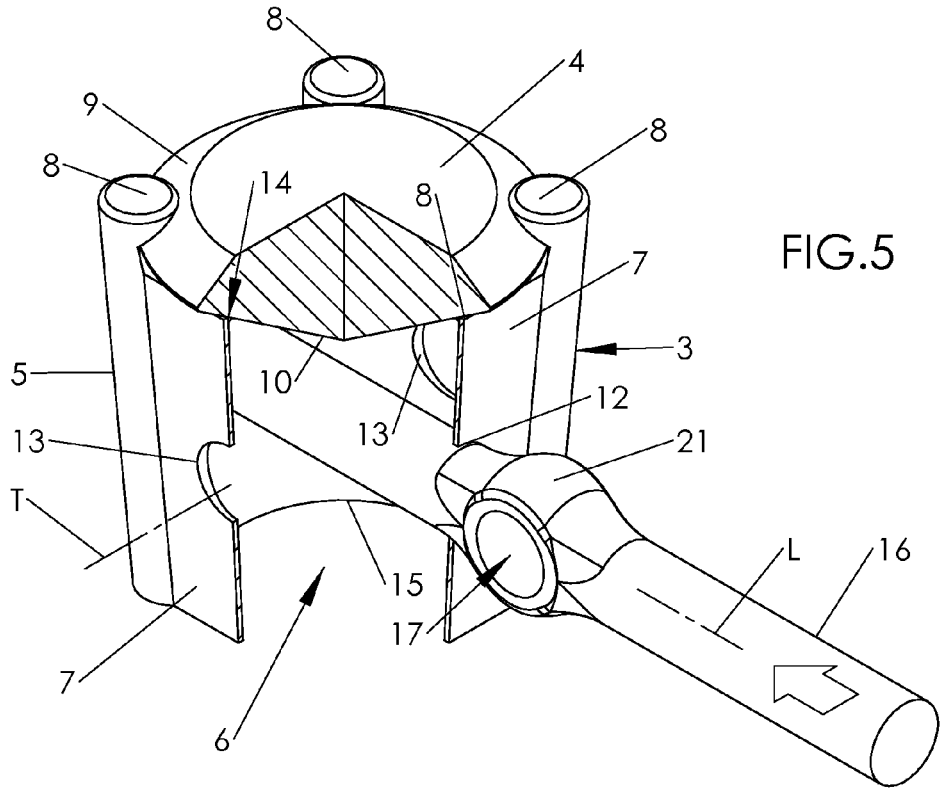

The thus drilled wire 16 is then longitudinally introduced in the bezel 3, through one hole 12 (FIG. 5). As the diameter of the hole 12 is equal (with a clearance) to the diameter of the wire 16, the roll temporarily creates a resistance, which is overcome by pulling the wire 16, the elasticity of which is sufficient for the roll to rub and pass through the hole 12.

Figure 6:
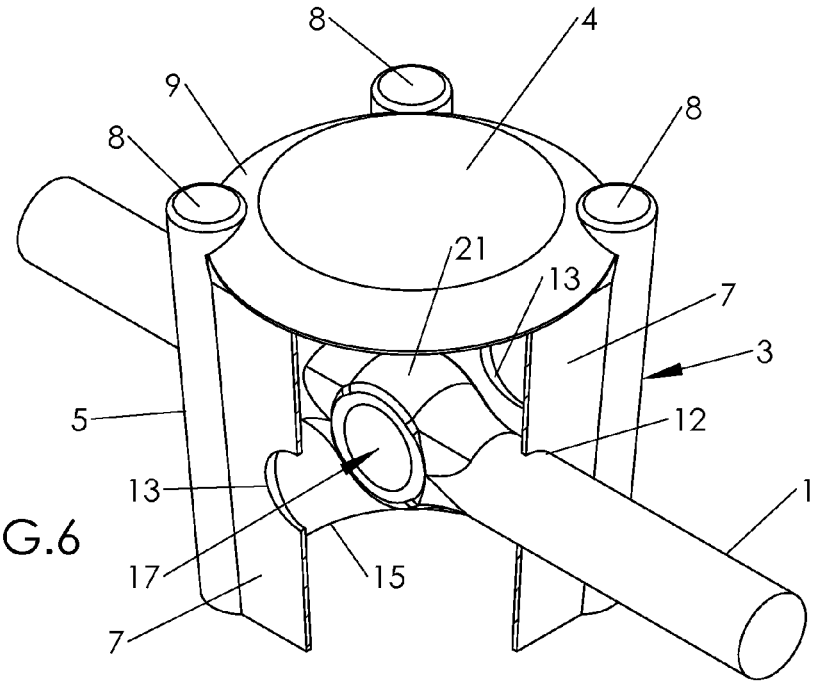
Figure 7:
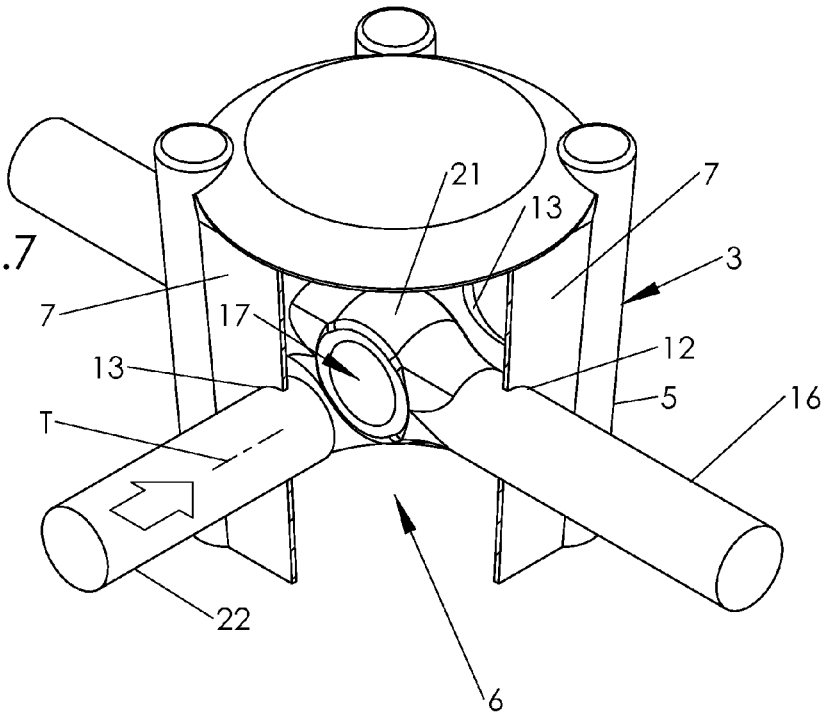
Figure 8:
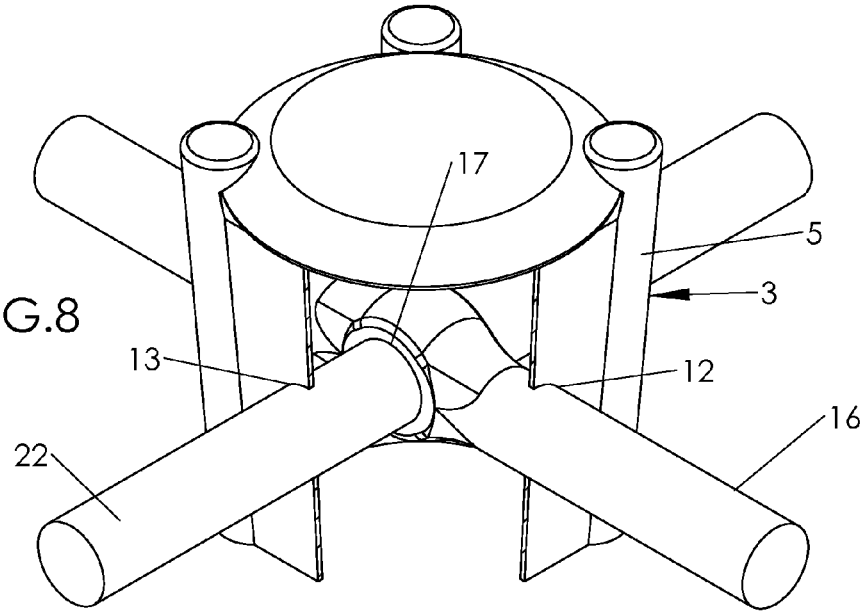

Once this operation complete, the wire 16 longitudinally goes through the body 5 of the bezel 3, through both coaxial holes 12 facing each other, whereas the bore 17 in the wire 16 is then localized in the cavity 6 (FIG. 6).

The wire 16 is longitudinally adjusted to set the bore 17 at the level of both other holes 13, and the wire 16 is turned to orient the bore 17 transversally in the axis T of holes 13 (FIG. 6).

A stop element 22 is then transversely inserted in the body 5, both through the holes 13 of transversal axis T and through the bore 17.

Once introduced, the stop element 22 extends transversely in the cavity 6 through the bore 17; it engages the edges of the transversal holes 13 which form stop surfaces for the element 22 in rotation around the longitudinal axis L, and in longitudinal translation. Acting as a pin, the stop element 22 thus mutually blocks the bezel 3 and the wire 16 both in longitudinal translation, and in rotation around the longitudinal axis L. In other words, the wire 16 and the stop element 22 altogether form a cross which ensures the complete blocking of the bezel 3 onto the wire 16.

The stop element 22 is preferably of cylindrical shape and has a diameter equal (with a clearance) to the diameter of the holes 13 and the bore 17. The stop element is e.g. a metal pin, the length of which is equal to the distance between the faces 7 of the body 5, such that when suitably positioned the ends of the rod 22 are flush with those faces 7, the pin 22 being virtually invisible to the human eye.

Figure 9:
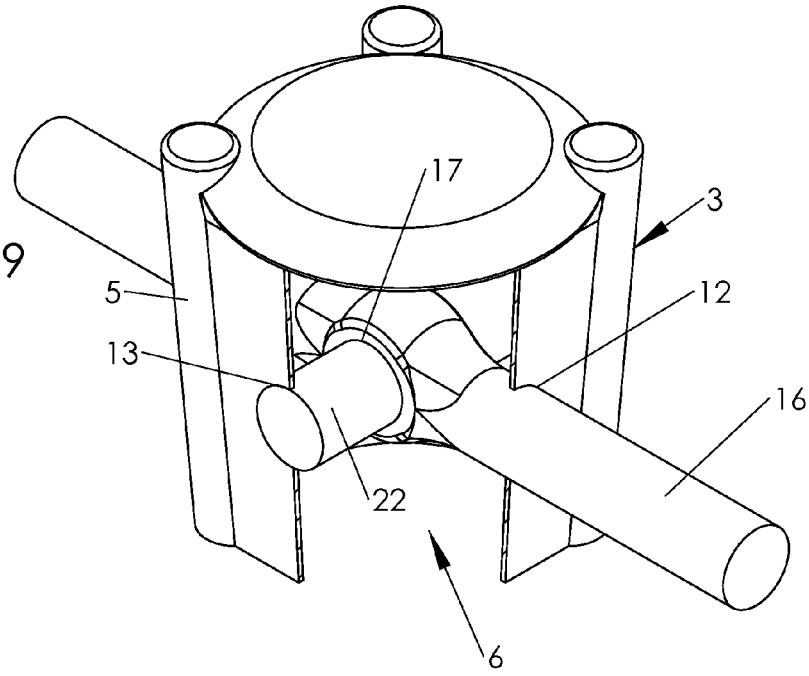

However, in a preferred embodiment, the stop element 22 is formed of a portion of the same wire 16 that the one used for the mounting of the bezel 3. Depending upon the jewel model which it is intended to manufacture, the section of wire used for making the stop element 22 may be:

cut at both ends protruding from the body 5, in order to make those end flush and thus to make the stop element 22 almost invisible to the human eye (FIG. 9);

cut at one end only, or not cut, when the portion of wire used is otherwise used as a support for other bezels, or when this wire portion is a buckle following the support wire 16.

Figure 10:
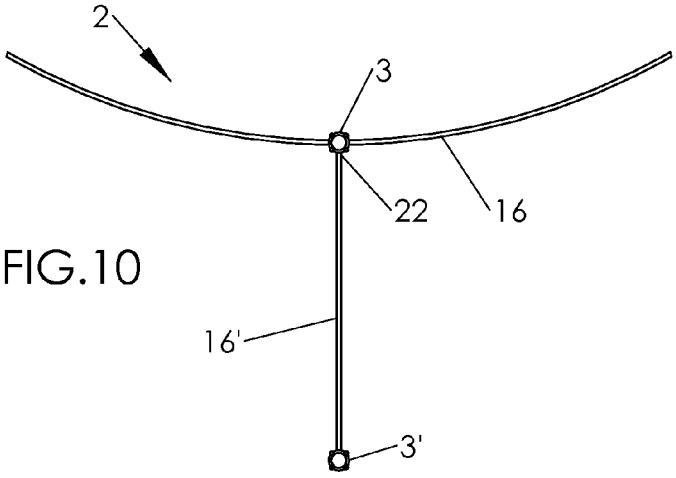
FIG. 10 is a partial top view showing an example of a necklace which may be manufactured with a technique according to the invention.
Figure 11:
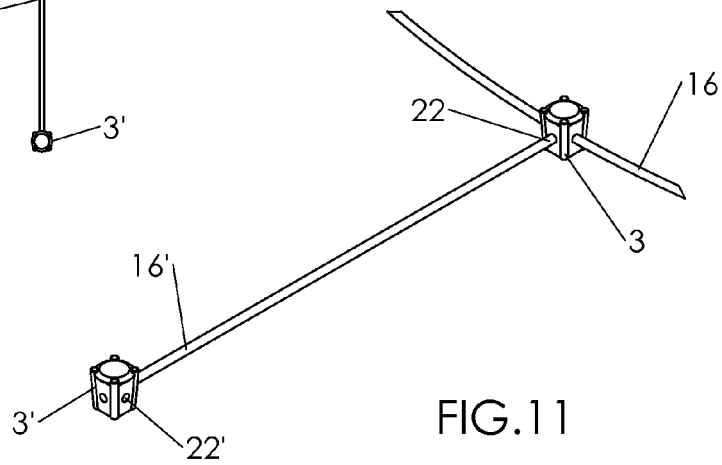
FIG. 11 is a perspective view showing a detail of the necklace of FIG. 10.

Partly represented on FIG. 10 and FIG. 11 is a necklace 2 with a pendent made with two crossed wires, i.e. a primary wire 16 which supports a first bezel 3, through which it goes from side to side, and a secondary wire 16' an upper end 22 of which forms a stop element passing through the primary wire 16 and blocking the bezel 3 both in translation and in rotation with respect thereof. At a lower end, the secondary wire 16' supports a second bezel 3', which is blocked both in translation and in rotation with respect of the secondary wire by means of a stop element 22' which passes through the secondary wire 16' and is cut at both end not to protrude from the bezel 3'.

The thus manufactured jewel 2, as any other jewel made with this technique (e.g. having volutes, buckles, etc.) has an increased resistance to external constraints (such as torsion, flexion, traction), the crosses tending to resiliently bring the bezels 3 back to their original position.

The invention claimed is:

1. A jewel comprising:

a decorative element such as a precious stone, a bezel including a body provided with at least one hole defining a longitudinal direction, the body having claws mounted thereon, which secure said decorative element, a wire support on which the bezel is mounted, the wire support extending longitudinally through the body of the bezel through the hole, wherein the wire support has a bore located in the body, the jewel further comprises an elongated stop element, which extends transversely in the body while passing through the bore formed in the wire support, the stop element is engaged with stop surfaces formed within the body.

2. The jewel according to claim 1, wherein the stop surfaces are formed by edges of holes provided transversally in the body of the bezel.

3. The jewel according to claim 1, wherein the stop element is formed from a portion the same wire as of the wire support.

4. The jewel according to claim 3, wherein the bezel is a first bezel, the jewel comprising a second bezel; and wherein the wire is a primary wire that supports the first bezel, the jewel further comprising a secondary wire having an upper end forming a stop element passing through the primary wire and blocking the first bezel and a lower end that supports the second bezel.

5. The jewel according to claim 1, wherein the wire support is a wire made of a transparent or translucent thermoplastic material.

6. The jewel according to claim 5, wherein the wire support is a monofilament line.

7. The jewel according to claim 1, wherein the wire support is made from a thermoplastic material.

8. The jewel according to claim 1, wherein the wire support is made from a polyamide material.

9. A method of manufacturing a jewel comprising at least a bezel including a body provided with at least one hole defining a longitudinal direction, the body having claws mounted thereon, which secure said decorative element, and at least one wire support, wherein said method includes the following operations:

longitudinally introducing the wire support in the bezel through the hole, introducing an elongated stop element in the body through a bore formed in the wire support and located in the body, placing the stop element in engagement with stop surfaces formed in the body.

10. The method according to claim 9, wherein introducing the elongated stop element in the body is achieved through a pair of holes formed transversally in the bezel, the edges of which form said stop surfaces.

11. The method according to claim 9, wherein a drilling of the wire support is provided before introducing the wire support in the bezel.

12. The method according to claim 9, further including cutting the stop element, on one side at least of the bezel.

13. A jewel comprising:

a decorative element;

a bezel including a body provided with two holes defining a first longitudinal direction, the body comprising claws that secure the decorative element;

a wire on which the bezel is mounted, the wire extending in the first longitudinal direction and through the two holes;

wherein the wire has a bore through the wire in a direction transverse to the first longitudinal direction and wherein the bore is located in the body;

wherein the jewel further comprises an elongated stop element that extends in a second longitudinal direction transverse to the first longitudinal direction, through a third opening in the body and passing through the bore formed in the wire; and wherein the stop element prevents the wire from moving relative to the body in both the first longitudinal direction and the second longitudinal direction.

14. The jewel according to claim 13, wherein the wire is made from a flexible thermoplastic material.

* * * * *